US007010393B2

(12) United States Patent
Mirsky et al.

(10) Patent No.: US 7,010,393 B2
(45) Date of Patent: Mar. 7, 2006

(54) CONTROLLING MULTIPLE PUMPS OPERATING IN PARALLEL OR SERIES

(75) Inventors: Saul Mirsky, West Des Moines, IA (US); Krishnan Narayanan, West Des Moines, IA (US)

(73) Assignee: Compressor Controls Corporation, Des Moines, IA (US)

( * ) Notice: Subject to any disclaimer, the term of this patent is extended or adjusted under 35 U.S.C. 154(b) by 32 days.

(21) Appl. No.: 10/464,931

(22) Filed: Jun. 19, 2003

(65) Prior Publication Data

US 2003/0235492 A1 Dec. 25, 2003

Related U.S. Application Data

(60) Provisional application No. 60/390,072, filed on Jun. 20, 2002.

(51) Int. Cl.
*G05D 11/00* (2006.01)

(52) U.S. Cl. ..... 700/282; 417/1

(58) Field of Classification Search ..... 700/282; 417/5, 20, 43, 300, 1, 2; 415/1
See application file for complete search history.

(56) References Cited

U.S. PATENT DOCUMENTS 5,347,467 A * 9/1994 Staroselsky et al. ..... 700/282
6,045,332 A * 4/2000 Lee et al. ..... 417/5
6,217,288 B1 * 4/2001 Mirsky et al. ..... 417/53
6,602,057 B1 * 8/2003 Saxena et al. ..... 417/286

* cited by examiner

*Primary Examiner*—Leo Picard
*Assistant Examiner*—Alexander Kosowski
(74) *Attorney, Agent, or Firm*—Sturm & Fix LLP

(57) ABSTRACT

Often, an application or process calls for multiple pumps operating within a piping network. Pump load, such as flow rate or pressure, is shared between these multiple pumps. The present disclosure relates to effective means of distributing the pumping load in a manner that satisfies the process requirements while keeping the pumping machinery safe from functioning in damaging operating regions. It also discloses a method of operating pumps in an efficient or optimal fashion. An additional aspect is a method of using an open-loop response to deal with large transients threatening to force a pump into an operating region that might result in damage or destruction.

34 Claims, 14 Drawing Sheets

CONTROLLING MULTIPLE PUMPS OPERATING IN PARALLEL OR SERIES

CROSS REFERENCE TO RELATED APPLICATIONS

This application contains disclosure from and claims the benefit under Title 35, United States Code, §119(e) of the following U.S. Provisional Application: U.S. Provisional Application Ser. No. 60/390,072 filed Jun. 20, 2002, entitled METHOD AND APPARATUS FOR CONTROLLING MINIMUM CONTINUOUS STABLE FLOW OF A PUMP STATION WITH MULTIPLE DYNAMIC PUMPS.

STATEMENT REGARDING FEDERALLY SPONSORED RESEARCH OR DEVELOPMENT

Not applicable.

REFERENCE TO MICROFICHE APPENDIX

Not applicable.

TECHNICAL FIELD

This invention relates generally to a method and apparatus for automatic control of multiple pumps operated either in parallel (to increase flow rate to and/or from the process) or in series (to increase the overall head). More specifically, the invention relates to a method for manipulating the operation of pumps, thereby preventing them from reaching their minimum flow limit until process requirements are such that all pumps must reach their respective limits. This course of action drastically reduces the chances of damage due to operation beyond the above-mentioned limit, as well as reducing the likelihood of inefficient recycling (to avoid running below the pumps' minimum flow limits).

BACKGROUND ART

Multiple centrifugal or axial pumps are frequently installed in piping systems to increase the overall flow rate to a process (in this case, pumps are operated in parallel), or to increase the overall head produced by the pump combination (pumps are operated in series).

Typically, there is a minimum flow limit to the acceptable flow through a pump. When flow rates are "low," some pumps experience higher levels of vibration and noise, as well as elevated temperatures (due to low efficiencies). This minimum flow limit is referred to as the Minimum Continuous Stable Flow (MCSF) limit. The level at which vibration or noise becomes unacceptable is specified by the customer, often referring to an industry standard.

Additionally, when pumps are piped in parallel, there may be a range of operation where two flow rates exist for each head value; this occurs when pump performance curves exhibit a point at which the slope is zero when the flow is greater than zero. When two or more pumps are operated in parallel, it is possible for the operating point in a set of pumps to oscillate rapidly between these two flow rates while always maintaining the required head. This rapid change in flow rate can damage or destroy a pump and should be avoided. Many pumps are fitted with recycle or bypass valves for maintaining an adequate flow rate to avoid operating in this hazardous region.

Many pumps are driven with variable-speed drivers such as steam turbines. Varying a pump's speed can be used to control its performance. An alternative is to throttle the discharge valve to maintain performance. When multiple pumps are operated in a network, either parallel or in series, the control objective (usually a flow rate or pressure) can be divided between the pumps in an infinite number of ways.

Present-day speed control systems (for multiple pumps) do not consider the low flow limit. For example, one pump may be running at a high flow rate, while another pump requires an open recycle valve to maintain operation above its MCSF limit. This approach not only increases the risk of a pump operating beyond of its MCSF limit, but it is also inefficient. For these reasons, there is need of a more extensive approach for controlling multiple pumps operating in a network of pumps.

DISCLOSURE OF THE INVENTION

A purpose of this invention is to provide a method for controlling a set of pumps (centrifugal or axial) in a manner that reduces the chance of any pump operating in a zone in which damage or destruction, such as the Minimum Continuous Stable Flow (MCSF) limit, is likely to occur. Another purpose is to control a plurality of pumps, such that inefficient recycling or throttling is kept to a minimum.

To accomplish these objectives, pump performance curves are converted through a coordinate transformation known as affinity laws or pump laws that reduces three-dimensional maps to two-dimensional maps. An additional transformation maps the stable operating regions into a given range, e.g., $S \leqq 1$. All pumps are operated so as to equalize their values of S; in this way, no pump arrives at its MCSF limit until all pumps arrive at their respective limits. Therefore, inefficient recycling is avoided until absolutely necessary.

BEST MODE FOR CARRYING OUT THE INVENTION

When operating two or more centrifugal or axial pumps 103, 104 (FIGS. 1 and 2) in a piping network (either in parallel or series), there are infinite combinations of operating points that satisfy the process requirements. To maintain safe and efficient pump operation, while multiple pumps 103, 104 are functioning simultaneously in the same piping network, each pump's operating point must be observed with respect to its minimum flow limit. As mentioned, pumps may be operated in parallel (FIG. 1) or in series (FIG. 2); combinations of parallel and series can be managed similarly.

Figure 1:
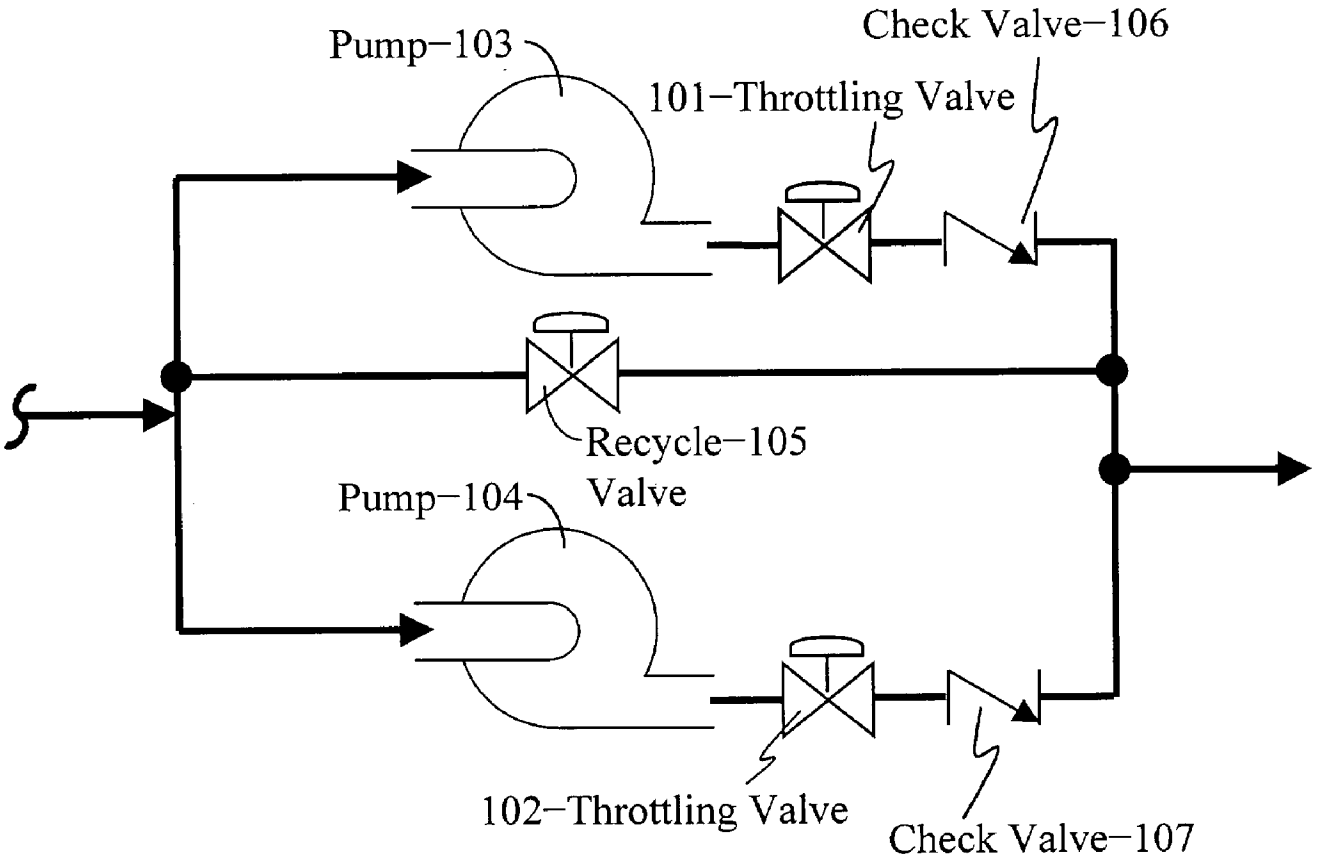
FIG. 1 shows two pumps in parallel.
Figure 2:
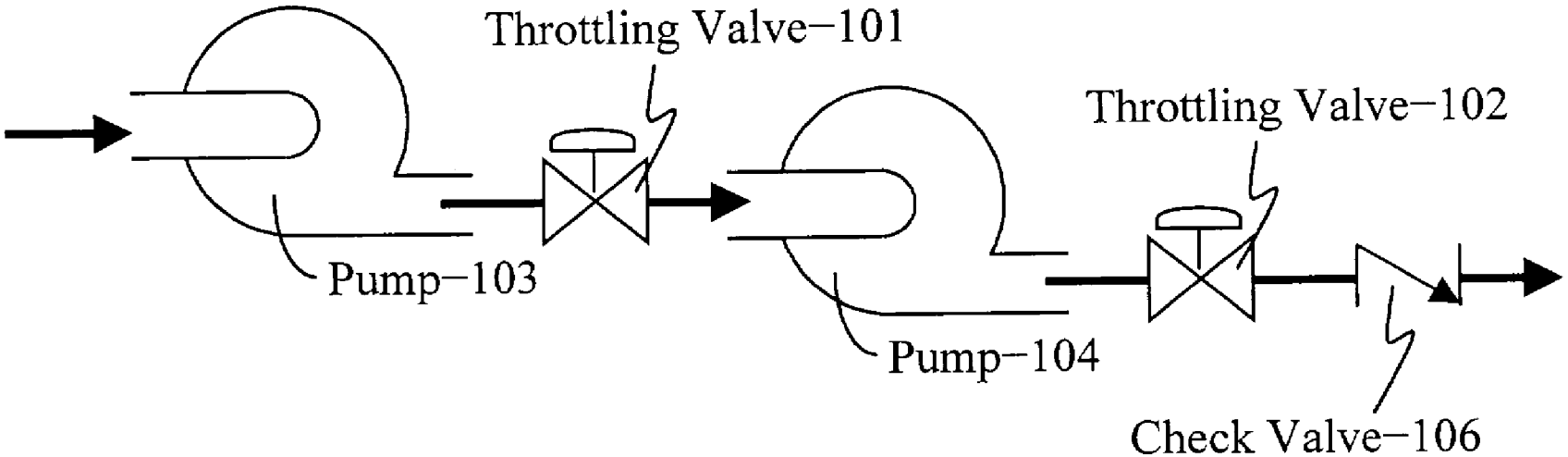
FIG. 2 shows two pumps in series.
Figure 11:
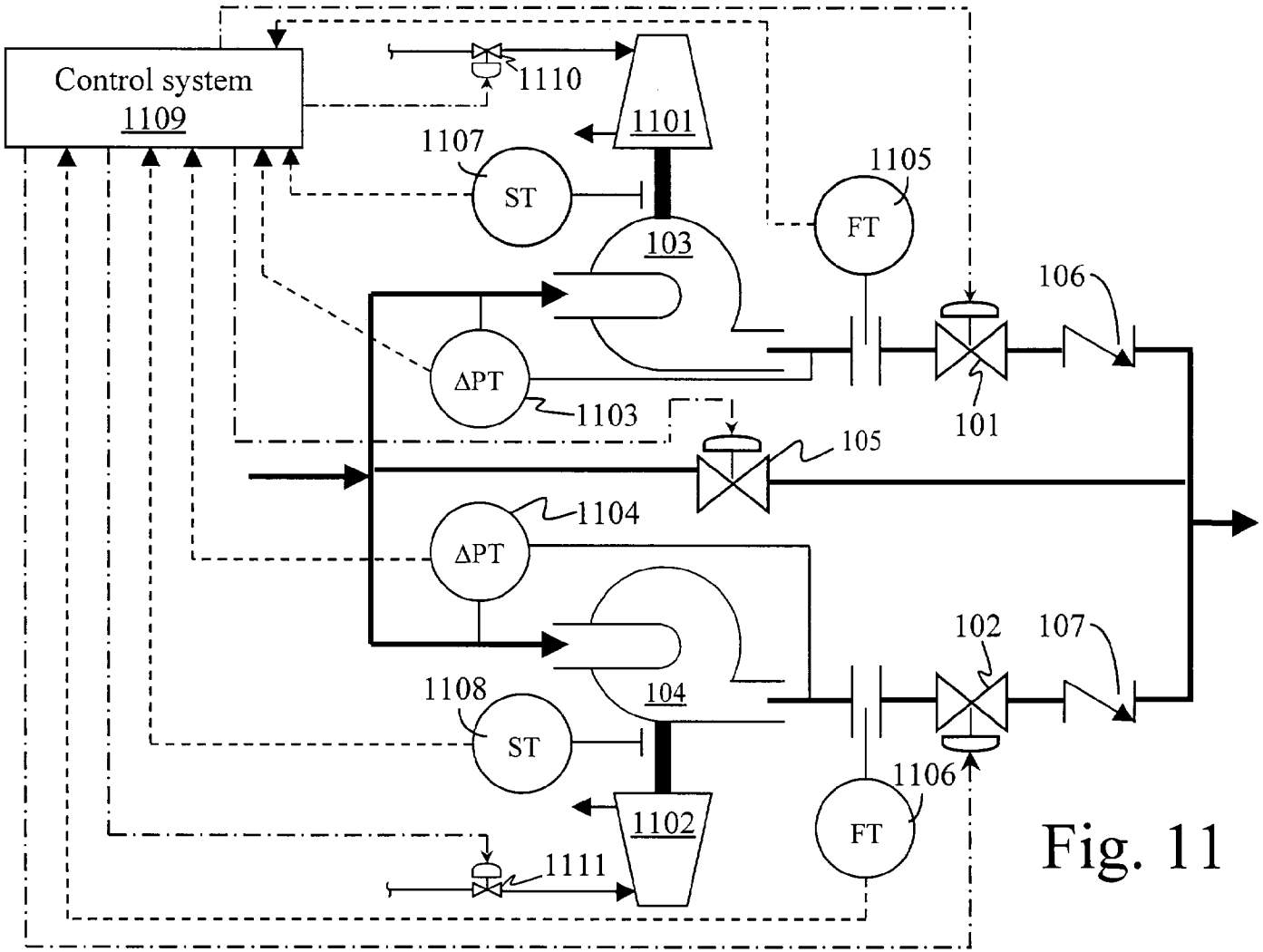
FIG. 11 shows two pumps in parallel with steam turbine drivers, transmitters, and a control system.

Pump performance can be controlled through changes in rotational speed (see FIG. 11: 1107, 1108) or through throttling valves 101, 102 usually in the discharge of a pump, as shown in FIGS. 1, 2 and 11, upstream of the check valves 106, 107. The present invention is also applicable to pumps having variable geometry for controlling their performance.

Figure 3:
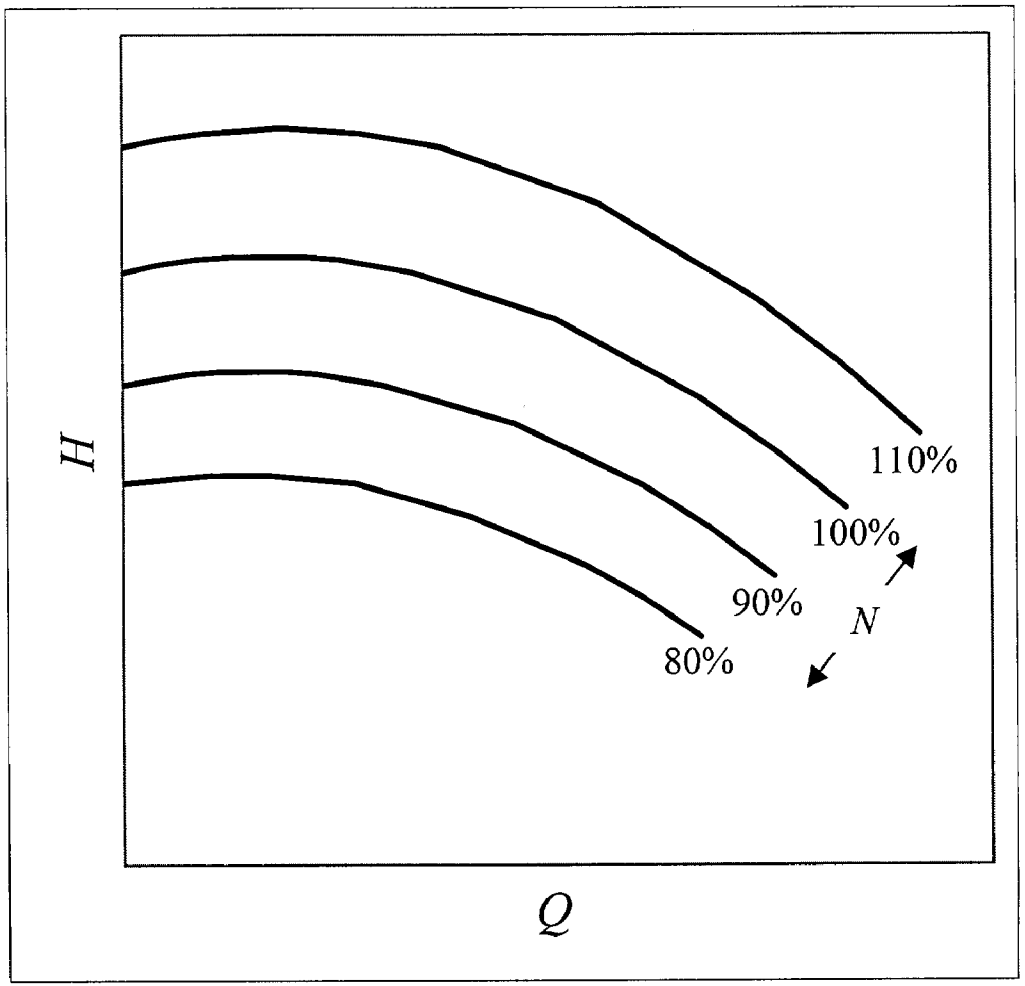
FIG. 3 shows a pump performance map.

FIG. 3 shows a pump performance map where each of the four performance curves is for a different rotational speed, N. The abscissa is volumetric flow rate (Q) and the ordinate is the head [$H=\Delta p/(\rho g)$] developed by a pump. Manufacturers of pumps usually provide these type maps to customers and contractors.

Figure 4:
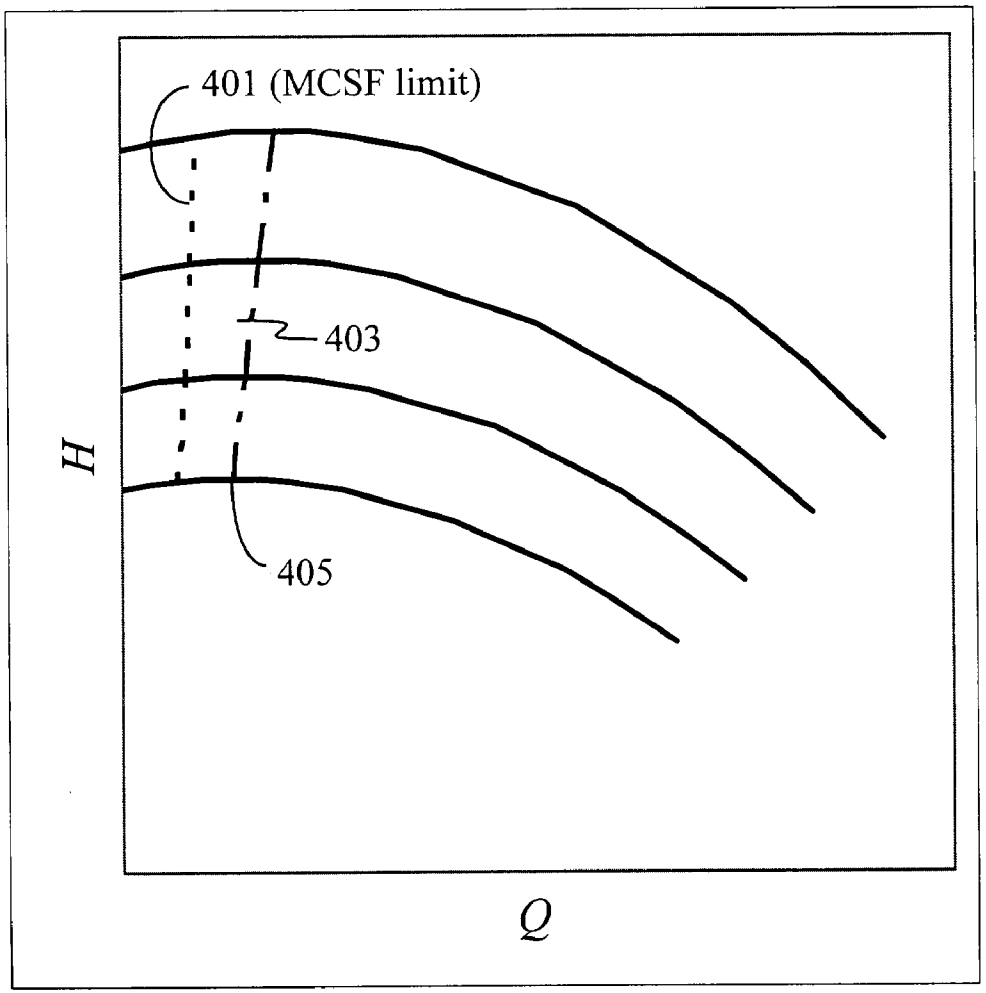
FIG. 4 shows a pump performance map with a minimum flow limit.

Acceptable flows for most pumps 103, 104 lie to the right of a limit, as shown in FIG. 4 where the left-hand boundary is the Minimum Continuous Stable Flow (MCSF) limit 401. When a pump 103, 104 is operated in the region to the left of this limit 401, vibration and pump noise can become excessive; while, at the same time, the temperature of the pumped liquid can rise to unacceptable limits due to the low efficiency of the pumping process. Furthermore, recirculation may occur in the pump inlet or outlet (or both); and accordingly, pump vanes can be eroded during this activity. Therefore, it is a desired result of the control system to avoid operation in this region.

The control system is not concerned with the actual MCSF limit 401, but rather with an artificial limit situated a safe distance from the actual pump MCSF limit 401. The distance between the actual MCSF limit 401 and the control-system limit (referred to here as the "control limit") is the safety margin. The pump map (FIG. 4) displays the safety margin 403 along with the MCSF control limit 405. The actual MCSF limit 401, as reported by the pump manufacturer, may already contain a margin of safety 403. Also, it may be permissible to momentarily operate the pump beyond the MCSF limit 401. As a result, there could be cases where the margin of safety 403 can be set to zero, so that the manufacturer's reported MCSF limit 401 is in the same location as the MCSF control limit 405. Because the control system does not make direct use of the actual MCSF limit 401 (only the MCSF control limit 405), any references to the MCSF "limit" in the remainder of this specification will denote the MCSF control limit 405 unless otherwise clearly specified.

By performing dimensional analysis on the important pump-variables, it is found that only two variables are required to describe a pump's characteristics: the flow coefficient [$Q/(D^3N)$] and the head coefficient [$Hg/(DN)^2$], where g is the acceleration of gravity and D is a characteristic length of the pump. These coefficients are part of the well-known pump laws or affinity laws. The four pump-characteristic curves of FIG. 3 all collapse into a single curve 501 (see FIG. 5) when transformed using these dimensionless variables. A significant advantage is obtained with this transformation when the MCSF limit 405 collapses into a point on the single curve 501. If this is not the case, the most conservative limit point may be used at all operating conditions, or the limit can be characterized as functions of rotational speed (or another variable).

Figure 6:
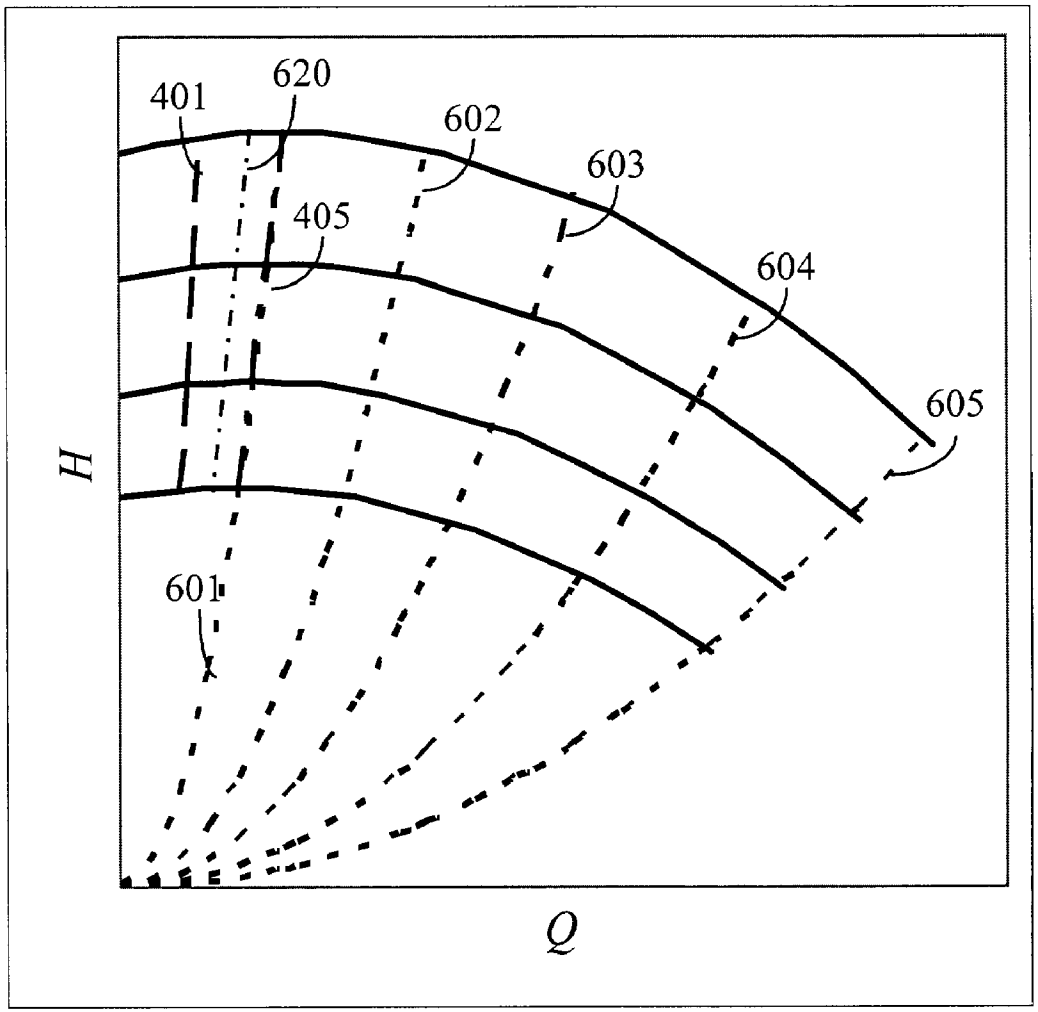
FIG. 6 shows a pump performance map with curves of constant S.

A simple scaling of the pump map (FIG. 6) can be used to scale all pump performance curves in a system, such that their minimum-flow control limit 600 has a predetermined value of a pump control variable such as S=1. This scaling is as follows:

$$S = K\frac{H}{Q^2} + b \tag{1}$$

where $K=Q^2/H$ on the actual MCSF limit 401, not the control limit [or $K=(Q^2/H)_{MCSF}$] and b is the safety margin. Curves 601–605 each having a constant S values are shown in FIG. 6. The MCSF limit line 401 is also shown in FIG. 6. Any known value for S at the minimum-flow control limit 405 is acceptable for this invention.

Figure 5:
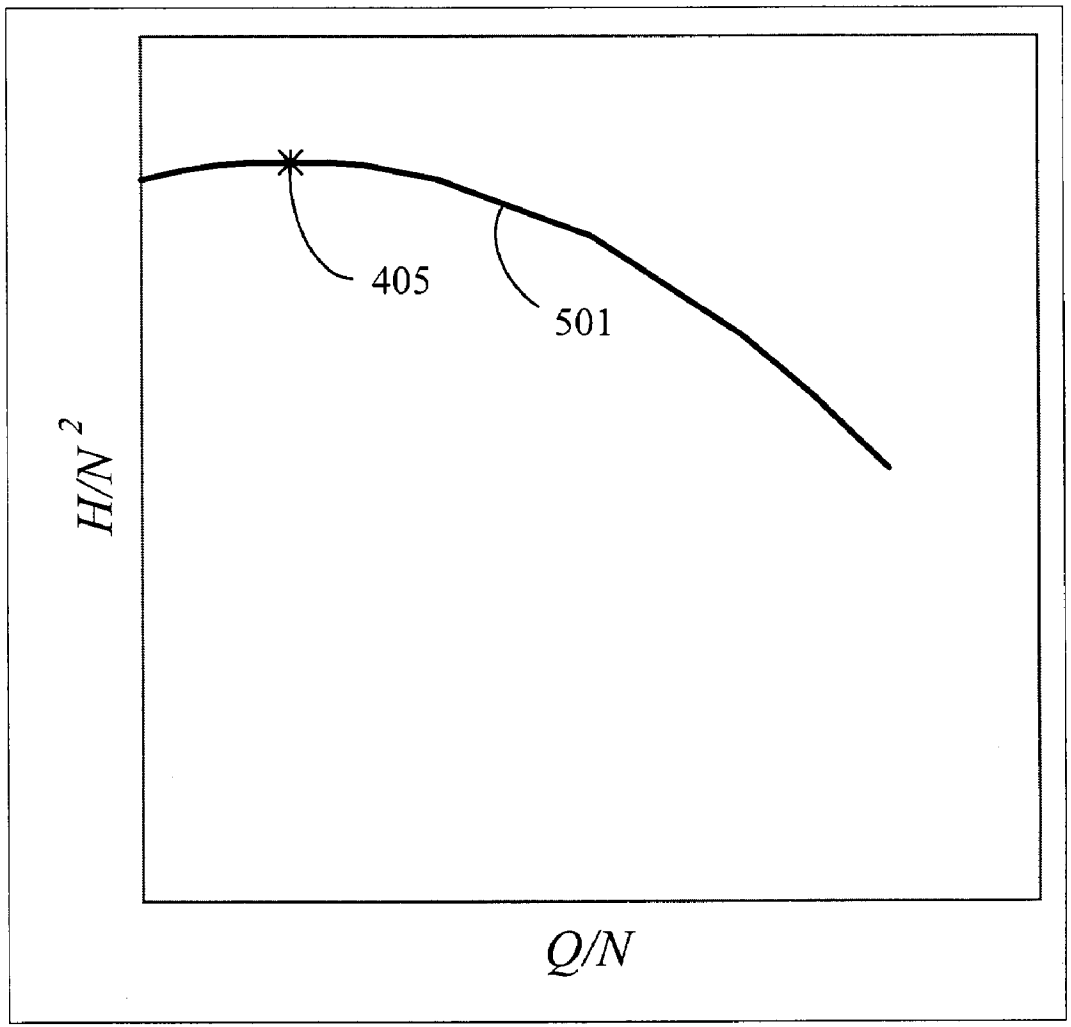
FIG. 5 shows a pump performance map, wherein the x- and y-coordinates are dimensionless parameters determined by dimensional analysis.
Figure 7:
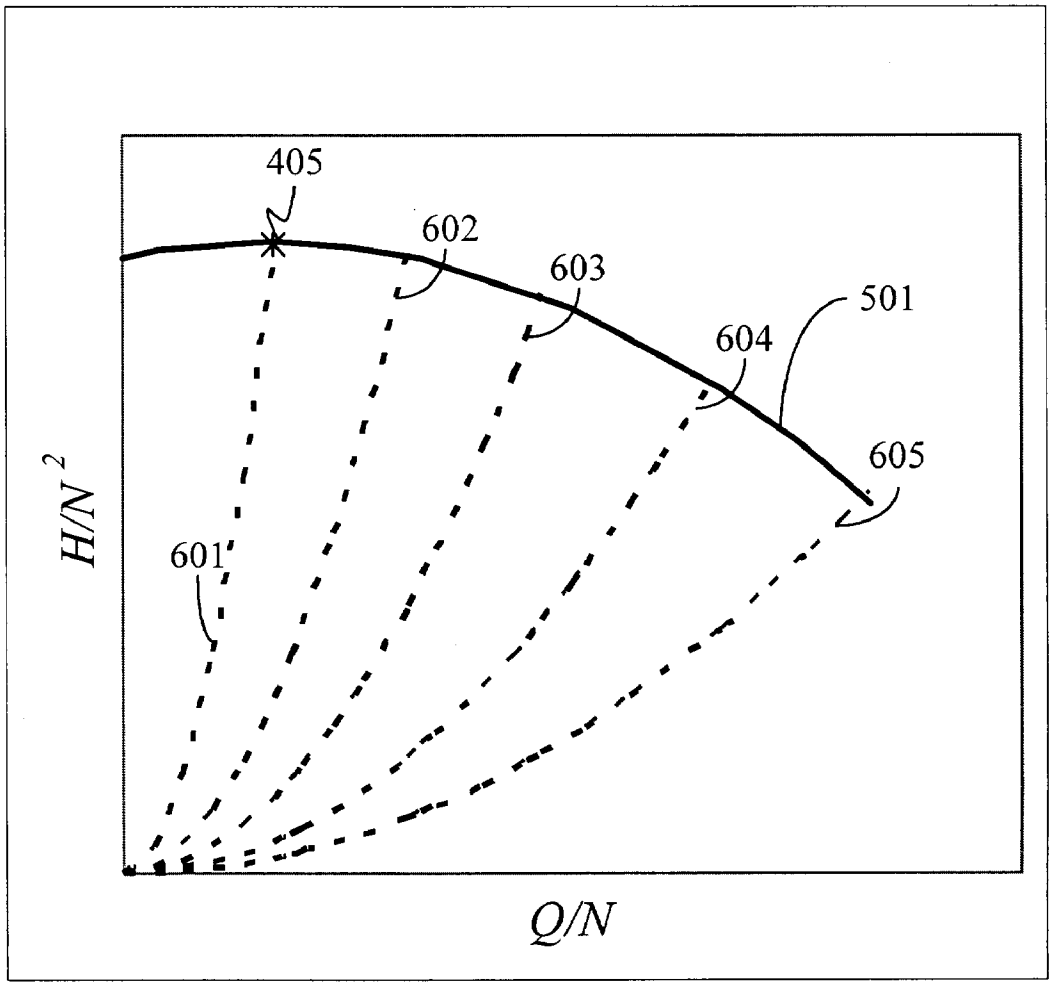
FIG. 7 shows a dimensionless pump performance map with curves of constant S.

In FIG. 7, the same curves of constant S 601–605 are shown in the dimensionless coordinate system of FIG. 5. The MCSF control limit 405 collapses into a point as shown in FIG. 7.

Figure 8:
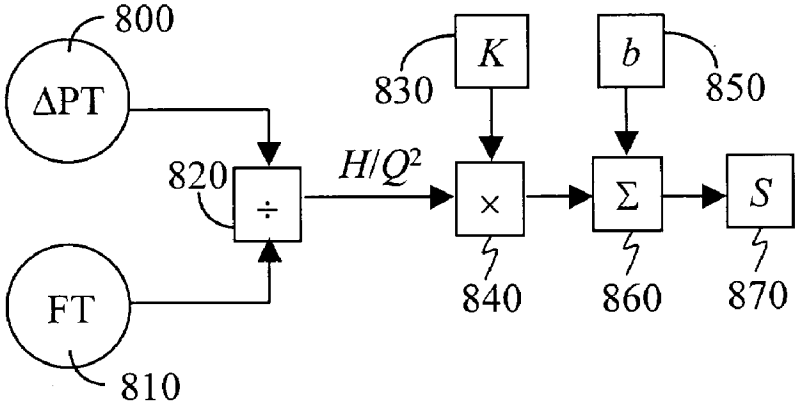
FIG. 8 shows a first method for calculating S.

FIG. 8 depicts the computation of Eq. 1, using two transmitters: a pump differential pressure transmitter, ΔPT 800, and a flow meter differential pressure transmitter, FT 810. $H/Q^2$ can be calculated as $$\frac{H}{Q^2} = \frac{p_d - p_s}{g\rho Q^2} \propto \frac{\Delta p_p}{\Delta p_o}$$

where $\Delta p_p$ is the pump differential pressure signal from the pump differential pressure transmitter, ΔPT 800, and $\Delta p_o$ is the differential pressure signal from the flow meter differential pressure transmitter, FT 810. A division block 820 produces the quotient, $\Delta p_p/\Delta p_o$. Multiplying this quotient by a constant, K 830, in a multiplier block 840 and summing this product with b 850 in the summation block 860 produces the value of S 870.

Many (in fact, an infinite number) other ways to scale the pump performance curve are available. Any scaling making the MCSF control limit a constant (and known) value may be valid and would be considered equivalent in the context of this invention. Other obvious choices include:

$$S = K\frac{Q}{N} - b \text{ and} \tag{2}$$

$$S = K\left(\frac{Q}{N}\right)^2 - b \tag{3}$$

where, for Eq. 2, $K=(N/Q)_{MCSF}$ and for Eq. 3, $K=(N/Q)^2_{MCSF}$ and, again, b represents the safety margin in each case. Each of the definitions of S (Eqs. 1–3) are equivalent, and many others are also valid. This invention is not limited to these definitions of the scaling, S.

Figure 9:
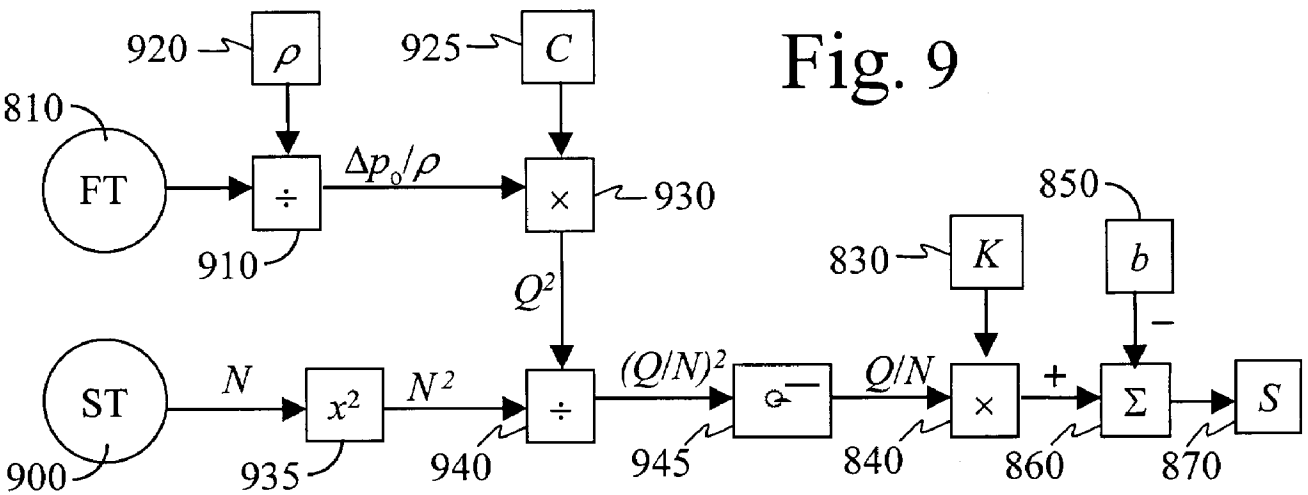
FIG. 9 shows a second method for calculating S.

FIG. 9 displays steps to calculate S based on Q/N as in Eq. 2, using two transmitters: a flow transmitter, FT 810, and a rotational speed transmitter, ST 900. A first division block 910 determines the quotient of the flow-transmitter signal ($\Delta p_o$) and the pumped-fluid density ($\rho$) 920, this quotient being proportional to volumetric flow rate squared, $Q^2$. This value and a constant, C 925, are acted on by a first multiplier 930 to generate a volumetric flow rate squared ($Q^2$). The rotational speed (N) signal from the rotational speed transmitter, ST 900, is squared in an exponent block 935, and then is divided into $Q^2$ in a second division block 940 to produce the quotient $(Q/N)^2$. The square root is taken of this quotient in the square root block 945 to yield Q/N. As before, a constant K 830 is passed into a second multiplication block 840 and the result added to the safety margin, b 850, in a summation block 860 to yield the value of S 870.

Figure 10:
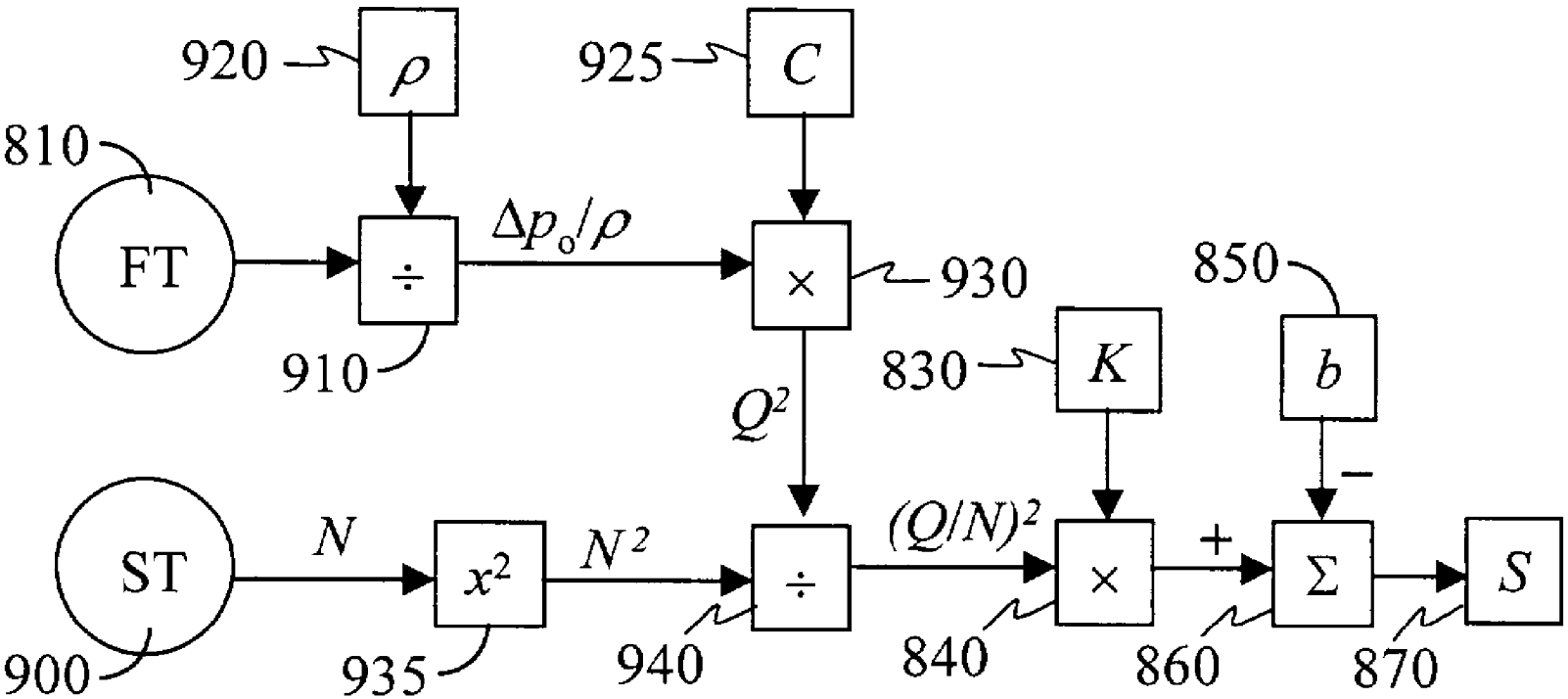
FIG. 10 shows a third method for calculating S.

FIG. 10 outlines the steps to calculate S 870 based on $(Q/N)^2$ as in Eq. 3, using two transmitters: a flow transmitter, FT 810, and a rotational speed transmitter, ST 900. A first division block 910 determines the quotient of the flow-transmitter signal ($\Delta p_o$) and the pumped-fluid density ($\rho$) 920, said quotient being proportional to volumetric flow rate squared, $Q^2$. This value ($Q^2$) and a constant (C) 925 are acted on by a first multiplier 930 to generate the value of the volumetric flow rate squared ($Q^2$). The rotational speed (N) signal, from the rotational speed transmitter, ST 900, is squared in an exponentiation block 935, then is divided into $Q^2$ in a second division block 940 to produce the quotient $(Q/N)^2$. Again, a constant K 830 is passed into the second multiplication block 840 and the result added to the safety margin, b 850, in a summation block 860 to yield the value of S 870.

Once S 870 is calculated using any of Eqs. 1–3 (or an equivalent form), the control system's job is to equalize the value of S 870 for all pumps 103, 104 during their operation while, simultaneously, process demands are met. A master PID controller 1201 (FIG. 12) is dedicated to assuring that the process variable set point (such as flow rate, pressure, or temperature) is satisfied. To accomplish this, the master PID controller 1201 simultaneously manipulates the performances (rotational speed and/or throttle-valve position) of all pumps 103, 104: master-controller action is often aggressive, but without causing instabilities.

A pair of load-sharing PID controllers 1202, 1203 (one for each pump 103, 104) are dedicated to equalizing (balancing) the values of S 870, which takes place somewhat slower than the master PID controller's 1201 action, to maintain the process variable on set point; as a result, balancing will not disturb the process.

There is also an advantage to scaling the pump performance maps in a given network: all S's 870 may be scaled to have the same value at the maximum-efficiency point for each pump; then, as the control system manipulates pump performance, such that the values of S 870 are equal, each pump 103, 104 will be the "same distance" from its highest efficiency.

Figure 13:
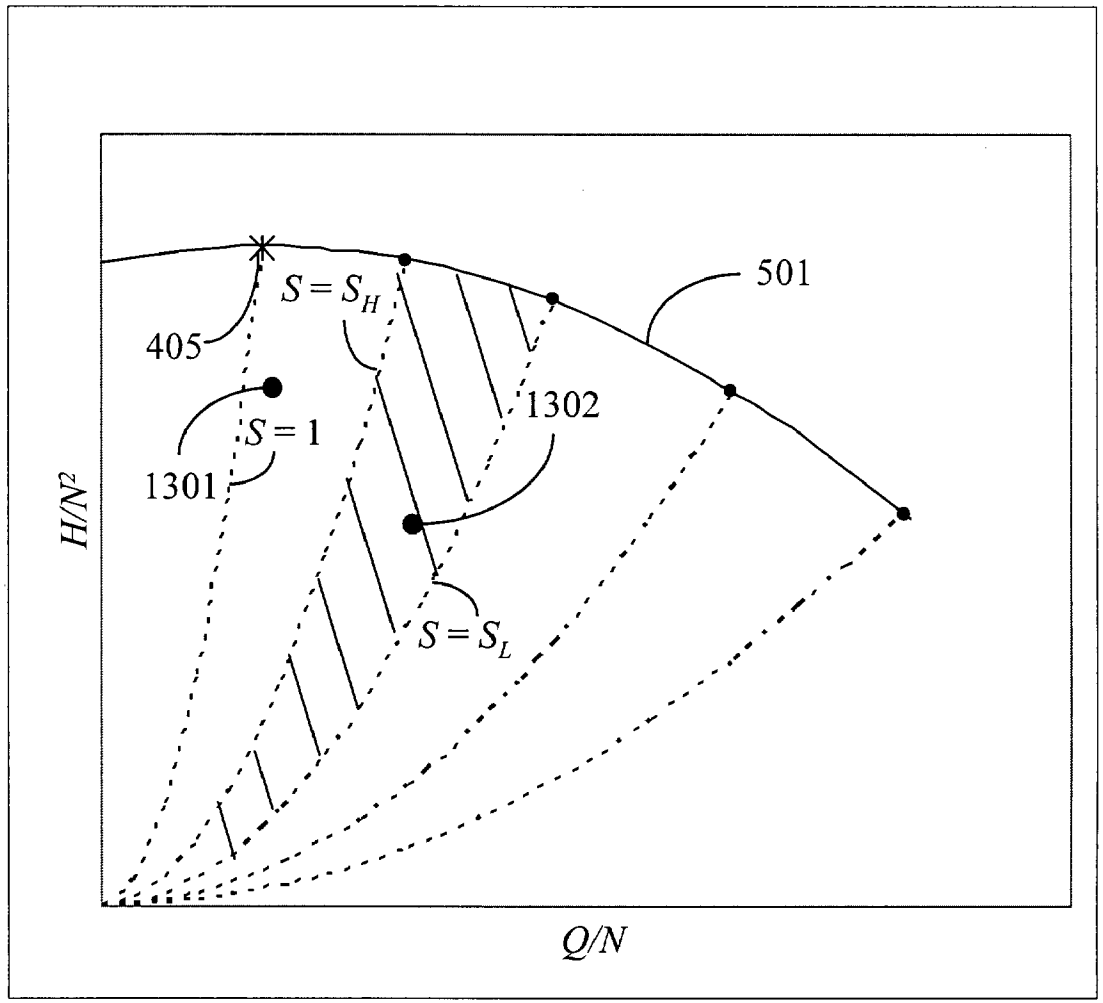
FIG. 13 shows a dimensionless performance curve with a transition region for controlling various parameters over the pump map region.

An additional embodiment of this invention is shown in FIG. 13, wherein the values of S 870 are only equalized within a region 1301 located between the MCSF limit 405 and the shaded region 1302. To the right of the region 1302, other criteria are used to determine the share of load each pump 103, 104 acquires. These criteria include balances that result in the least overall power; the least maintenance of the pumps 103, 104; and equal powers or equal flow rates. Within the shaded region 1302, a smooth interface is constructed; so that passing from one balancing criterion to the other will not cause instabilities. Such an interface can be constructed by defining a balancing parameter as:

$$B = \begin{cases} f(M) & S \le S_L \\ \dfrac{S - S_L}{S_H - S_L} S + \dfrac{S_H - S}{S_H - S_L} f(M) & S_L < S < S_H \\ S & S_H \le S \le 1 \end{cases} \tag{4}$$

where B is the parameter to be equalized for all pumps, and f(M) represents the balancing criterion used to the right of the region 1302 of FIG. 13. Numerous ways of providing a smooth transition between in this area and the shaded region 1302 can be constructed, and this invention is not restricted to the method given.

FIG. 11 shows two pumps 103, 104 in parallel driven by steam turbines 1101, 1102 providing variable rotational speed for the pumps 103, 104. Instrumentation comprises two pressure differential transmitters ($\Delta$PT) 1103, 1104; two flow transmitters (FT) 1105, 1106; and two rotational speed transmitters (ST) 1107, 1108. Each of these pairs of transmitters is for the pair of pumps. If n pumps were in the network, n sets of transmitters would be required. Signals generated by these six transmitters are fed to a control system 1109 whose outputs manipulate the turbines' steam flow rates and, as a result, the turbines' powers by way of two steam valves 1110, 1111. An equally valid method of controlling steam turbine performance is by modulating the throttling valves 101, 102 at the pumps' discharges.

Figure 12:
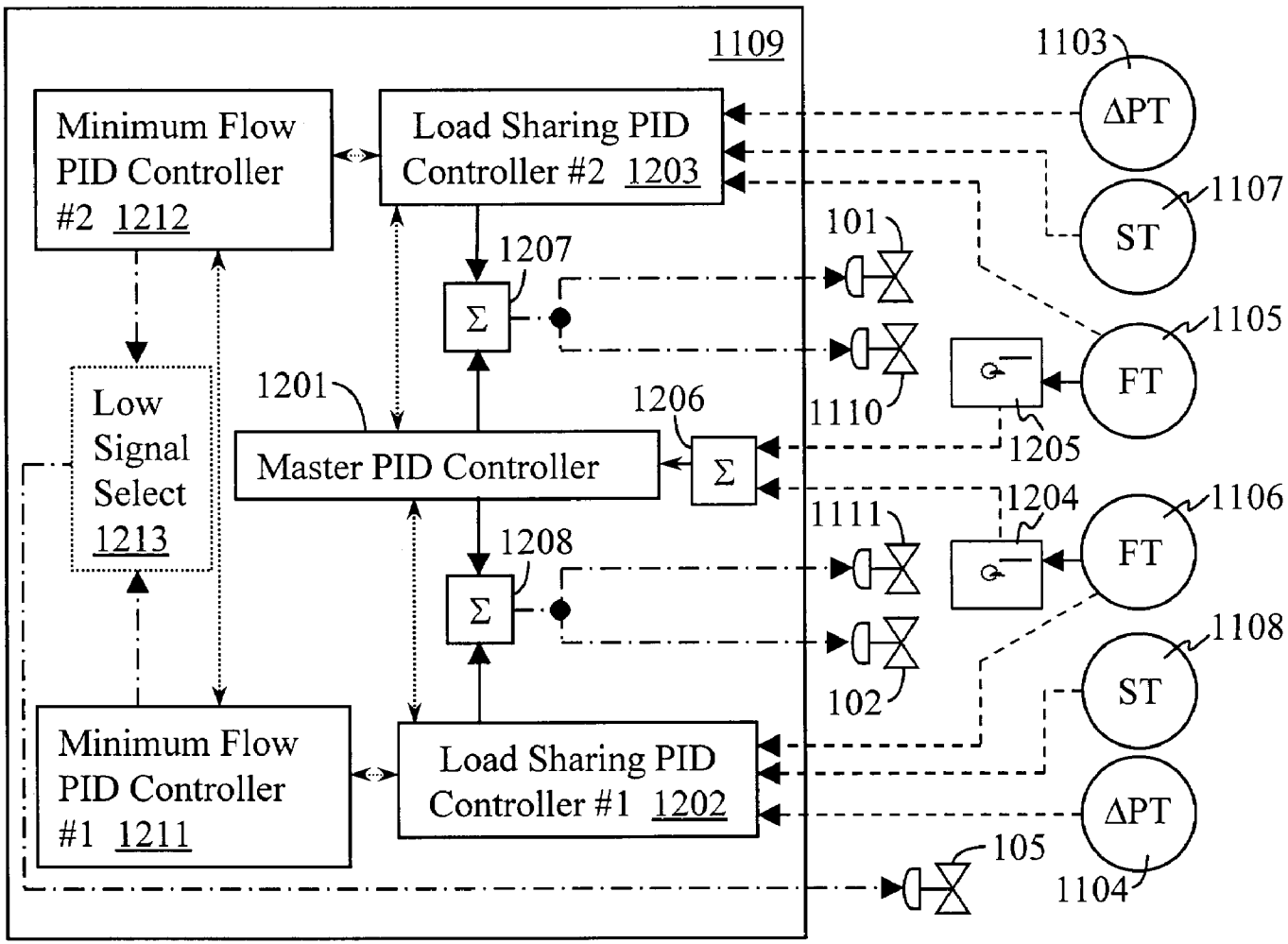
FIG. 12 shows details of a control system for multiple pumps.

Details of the FIG. 11 control system 1109 are called out in FIG. 12; and where each pump 103, 104 has a load-sharing PID controller 1202, 1203 receiving signals from each of the transmitters dedicated to their respective pumps 103, 104. A main controlled-variable such as the total flow rate (calculated by the square root 1204, 1205 of each flow signal, then summed 1206) is directed to a master PID controller 1201. Other types of main controlled-variables would be process pressure or temperature (for example, at the discharge of a heat exchanger). In any case, varying the pumps' performances must result in a predictable change in the main controlled-variable.

The master controller 1201 inputs to two summation blocks 1207, 1208; each summation block 1207, 1208 receives a signal from its corresponding load-sharing controller 1202, 1203. Once these signals are summed, the summation blocks' outputs set the positions of the steam valves 1110, 1111 (or throttling valves 101, 102 for constant rotational speed operation). These control actions may also be carried out in a split range approach, where the steam valves 1110, 1111 are manipulated until the rotational speed of the pumps reaches a lower limit, then the throttling valves 101, 102 are manipulated to further reduce the process flow rate.

Not shown are checks to determine if any pump has reached a speed limit (maximum or minimum). In case of a speed-limited pump, controllers would be prohibited from sending a signal that would cause the speed to move further into its limit; and the integral portion of the controllers would be turned off to eliminate integral windup.

Two minimum-flow PID controllers 1211, 1212 are dedicated to keeping pumps from crossing the MCSF control limit. As shown in FIG. 12, those signals needed to calculate the value of S 870 are received by way of the intercontroller communication lines; however, any of these signals could be inputted directly from the transmitters as well. The outputs of these two controllers 1211, 1212 are directed to a low-signal select block 1213 whose output is then used as a valve-position signal for the recycle valve 105. (If the recycle valve was fail-closed, the signal-select block 1213 would be a high-signal select.)

When all pumps 103, 104 reach their respective MCSF limits 600, varying the speed alone cannot keep them from crossing their limits while maintaining the process variable on its set point. If the MCSF limit is reached by all pumps, the overall recycle valve 105 is then opened by the minimum-flow PID controllers 1211, 1212 which permits sufficient flow to maintain stable and safe operation of all pumps 103, 104. Rotational speeds must also be manipulated simultaneously to keep all pumps on their respective control lines.

Referring back to FIG. 6, another aspect of the invention makes use of an additional, "open-loop limit" 620. If a disturbance is so severe as to allow the operating point to reach this open-loop limit 620, past the MCSF control limit 600, the control system will execute an open-loop response where the recycle valve 105 is opened by way of the minimum-flow PID controllers 1211, 1212 as quickly as possible and by a predetermined amount.

Figure 14:
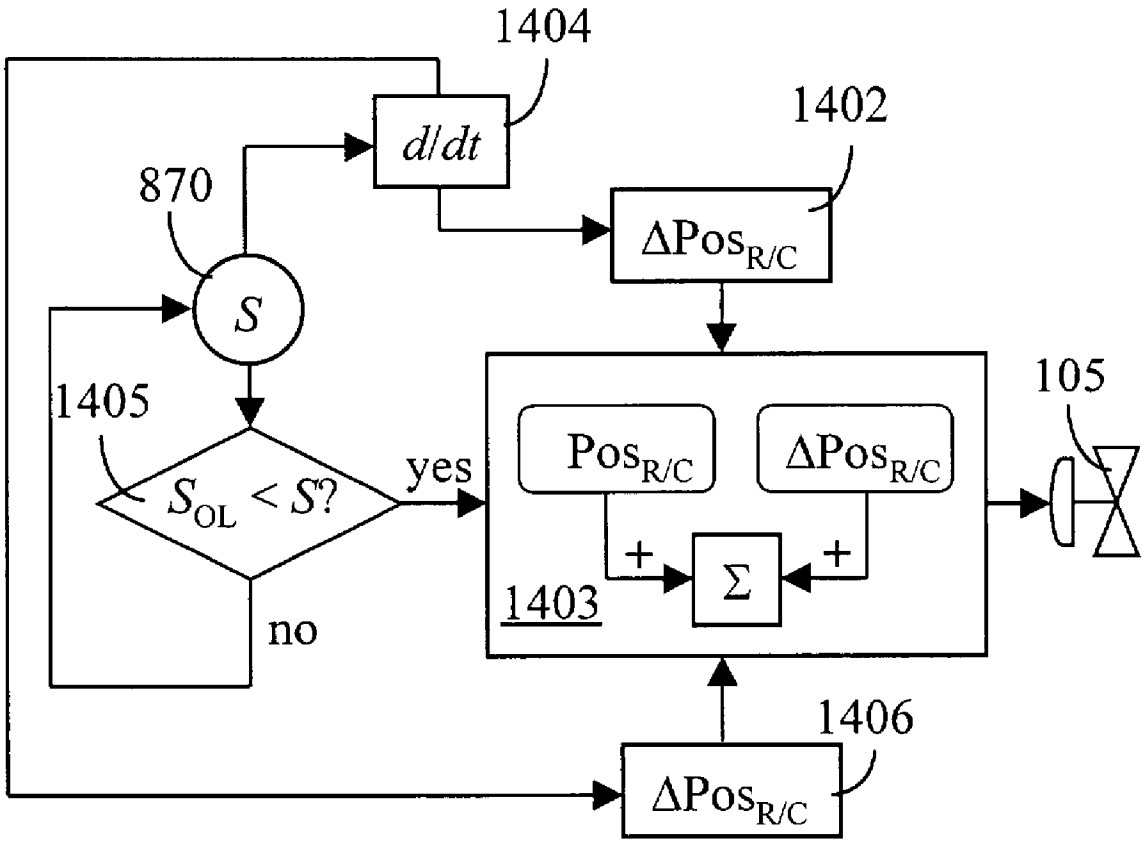
FIG. 14 shows a control flow-diagram for a single pump.

This open-loop control action is intended to prevent pump damage due to large, fast transients. The predetermined amount of opening of the recycle valve, can be made variable during pump operation as shown in FIG. 14. The system shown is for a single pump; additional pumps would have identical, individual systems. Having calculated S 870, using Eq. 1 or an equivalent form, a comparison 1405 is made with $S_{OL}$ which represents the value of S at the open-loop limit 620 where an open-loop response will be executed, thereby opening a recycle valve 105 a predetermined amount ($\Delta Pos_{R/C}$ 1402) as quickly as possible. If the present value of S 870 is greater than $S_{OL}$, the predetermined value $\Delta Pos_{R/C}$ 1402 is summed to the present valve position ($Pos_{R/C}$) in a function block 1403. The result of this calculation is used as a set point for the position of the recycle valve 105. A measure of the severity of a disturbance is the rate at which the operating point is moving in the direction of the actual pump's MCSF limit 610. This rate is determined by calculating the first time-derivative of the pump control variable, dS/dt 1404. For the preferred embodiment, the amount of opening ($\Delta Pos_{R/C}$ 1406) for open-loop responses is made proportional to the magnitude of dS/dt.

If the instantaneous value of S 870 is not greater than the open-loop limit, $S_{OL}$ 620, no additional change is made to the control system's valve-position set points.

Note that, if S 870 is calculated by Eq. 2 or Eq. 3, the comparison block 1405 would check if $S<S_{OL}$. The rest of the flow diagram in FIG. 14 would remain the same.

Figure 15:
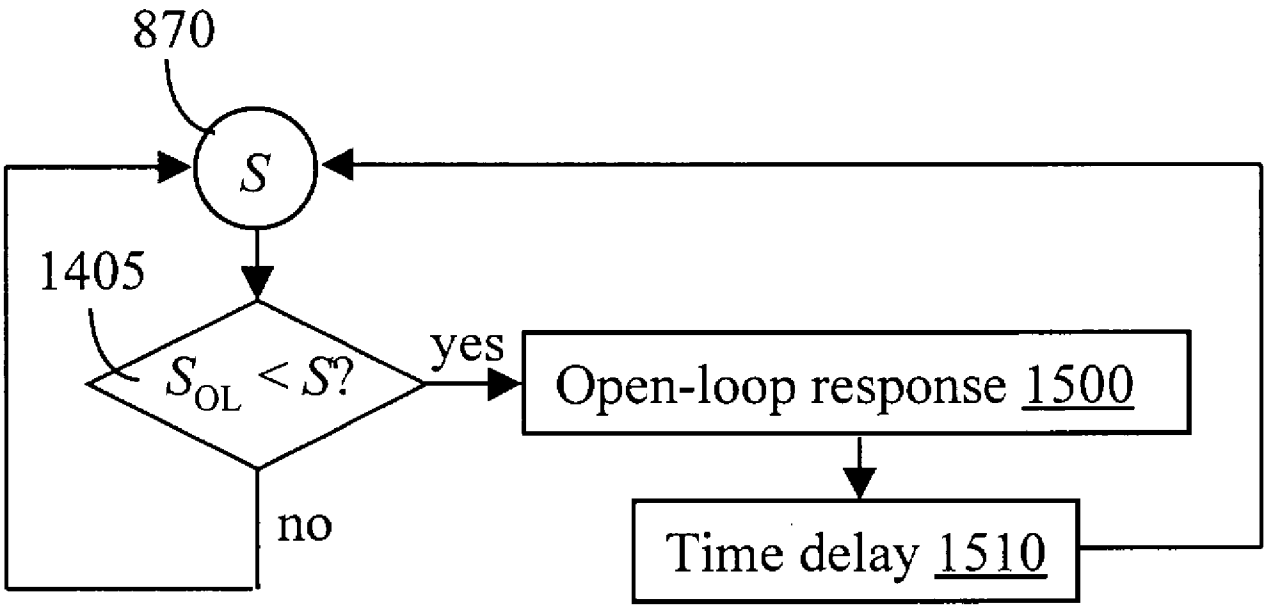
FIG. 15 shows a process that is executed repeatedly if the pump does not return to safe operation after a given open loop response is applied.

Often, an open-loop response will be applied only once; after that, the pump 103, 104 returns to safe operation. If this is not the case, a process illustrated in FIG. 15 is executed. After a predetermined increment of time 1510, the open-loop control system compares the value of S 870 with the value of $S_{OL}$ 620 and, if necessary, repeats the open-loop response 1500. This process continues until the pump's operating point returns to its safe operating region, to the right of the open-loop limit 620.

When a pump reaches its minimum-flow, open-loop limit (after opening the valve by the open-loop response), the recycle valve 105 is ramped closed at a predetermined rate, yet sufficiently slow to avoid returning the pump into the MCSF region 403. As the valve ramps closed, the closed-loop control system will take control of the valve when the operating point once again reaches the MCSF control limit.

As mentioned, some process functions are not unique; for example, normalizing of the flow coordinates, configuration of the pump network, and destination of the control system's outputs. The present invention is not limited to those examples described above, but may be realized in a variety of ways.

Obviously many modifications and variations of the present invention are possible in light of the above teachings. It is, therefore, to be understood that within the scope of the appended claims, the invention may be practiced otherwise than as specifically described.

We claim:

1. A method for controlling a pumping system comprising a plurality of variable-performance centrifugal or axial pumps, each having a Minimum Continuous Stable Flow control limit, pertinent instrumentation, and a control system, the method comprising manipulating a performance of the pumps, such that all pumps arrive at their respective Minimum Continuous Stable Flow control limits approximately simultaneously as a process flow rate is reduced.

2. The method of claim 1, wherein signals from the pertinent instrumentation are used to scale a pump map for each pump, calculating a pump control variable, S, such that each pump's Minimum Continuous Stable Flow control limit has a value equal to the Minimum Continuous Stable Flow control limits of all other pumps.

3. The method of claim 1, wherein the pertinent instrumentation comprises instrumentation for measuring a value related to a volumetric flow rate.

4. The method of claim 1, wherein pump performance is changed by varying a pump's rotational speed.

5. The method of claim 1, wherein pump performance is changed by varying a throttling valve's opening.

6. The method of claim 1, wherein upon reaching a preset value of a pump control variable, S, a recycle valve is opened a predetermined amount as quickly as possible.

7. The method of claim 6, wherein the predetermined amount of valve opening is variable during operation.

8. The method of claim 7, wherein the predetermined amount of valve opening is based on the speed at which a pump's operating point is moving in the direction of zero flow.

9. The method of claim 8, wherein the predetermined amount of valve opening is repeated at intervals until the pump returns to a safe operating region.

10. The method of claim 1, wherein the plurality of pumps is controlled to achieve a desired balance when pumps are operating far from their Minimum Continuous Stable Flow control limits.

11. The method of claim 10, wherein the desired balance results in a minimum total power.

12. The method of claim 1, wherein the pump control variable, S, is calculated as:

$$S = K\frac{H}{Q^2} + b$$

where Q is volumetric flow rate and H is head, while subscripts K and b are constants.

13. The method of claim 1, wherein the pump control variable, S, is calculated as:

$$S = K\frac{Q}{N} - b$$

where Q is volumetric flow rate and N is rotational speed, while subscripts K and b are constants.

14. The method of claim 1, wherein the pump control variable, S, is calculated as:

$$S = K\left(\frac{Q}{N}\right)^2 - b$$

where Q is volumetric flow rate and N is rotational speed, while subscripts K and b are constants.

15. The method of claim 1, wherein the control system comprises a master controller maintaining a main control-variable at its set point; and for each pump, at least one load-sharing controller maintaining a balance between all pumps sharing a pump load; each load-sharing controller being configured to equalize a distance from its pump's operating point to the Minimum Continuous Stable Flow control limit.

16. The method of claim 1, wherein the Minimum Continuous Stable Flow control limit is a function of the pump's operating conditions.

17. The method of claim 16, wherein the operating conditions, of which the Minimum Continuous Stable Flow control limit is a function, comprise a pump rotational speed.

18. An apparatus for controlling a pumping system comprising a plurality of variable-performance centrifugal or axial pumps, each having a Minimum Continuous Stable Flow control limit, pertinent instrumentation, means for manipulating each pump's performance, and a control system, the apparatus comprising means for maintaining approximately equal distances between all pumps' operating points and their respective Minimum Continuous Stable Flow control limits.

19. The apparatus of claim 18 including means for calculating a pump control variable, S, based on signals from the pertinent instrumentation, such that each pump's Minimum Continuous Stable Flow control limit has a value equal to the Minimum Continuous Stable Flow control limits of all other pumps.

20. The apparatus of claim 18, wherein the pertinent instrumentation comprises instrumentation for measuring a value related to a volumetric flow rate.

21. The apparatus of claim 18, wherein means for manipulating each pump's performance comprises means for varying a pump's rotational speed.

22. The apparatus of claim 18, wherein means for manipulating each pump's performance comprises means for varying a throttling valve's opening.

23. The apparatus of claim 18 including a control system for opening a recycle valve a predetermined amount as quickly as possible when a pump operating point reaches a preset value of a pump control variable, S.

24. The apparatus of claim 23 including a calculation unit for calculating a varying value for the predetermined amount of valve opening during operation.

25. The apparatus of claim 24 including means for basing the predetermined amount of valve opening on the speed at which a pump's operating point is moving toward zero flow.

26. The apparatus of claim 23 including means for repeating the predetermined amount of valve opening at intervals until the pump returns to a safe operating region.

27. The apparatus of claim 18 including a control system for controlling the plurality of pumps to achieve a desired balance when pumps are operating far from their Minimum Continuous Stable Flow control limits.

28. The apparatus of claim 27 including means to balance the pumps for minimum total power.

29. The apparatus of claim 18 including a calculation unit for calculating a pump control variable, S, as:

$$S = K\frac{H}{Q^2} + b$$

where Q is volumetric flow rate and H is head, while subscripts K and b are constants.

30. The apparatus of claim 18 including a calculation unit for calculating a pump control variable, S, as:

$$S = K\frac{Q}{N} - b$$

where Q is volumetric flow rate and N is rotational speed, while subscripts K and b are constants.

31. The apparatus of claim 18 including a calculation unit for calculating a pump control variable, S, as:

$$S = K\left(\frac{Q}{N}\right)^2 - b$$

where Q is volumeu-ic flow rate and H is head, while subscripts K and b are constants.

32. The apparatus of claim 18, wherein the control system comprises a master controller maintaining a main control-variable at its set point; and for each pump, at least one load-sharing controller maintaining a balance between all pumps sharing a pump load; the load-sharing controllers are configured to equalize a distance to the Minimum Continuous Stable Flow control limit.

33. The apparatus of claim 18 including means to calculate the Minimum Continuous Stable Flow control limit as a function of the pump's operating conditions.

34. The apparatus of claim 33, wherein the operating conditions, of which the Minimum Continuous Stable Flow control limit is a function, comprise a pump rotational speed.

* * * * *